US007244127B2

(12) United States Patent
Hasegawa

(10) Patent No.: US 7,244,127 B2
(45) Date of Patent: Jul. 17, 2007

(54) ANISOTROPIC CONDUCTIVE SHEET AND ITS MANUFACTURING METHOD

(75) Inventor: Miki Hasegawa, Aichi (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/508,050

(22) PCT Filed: Mar. 20, 2003

(86) PCT No.: PCT/JP03/03463

§ 371 (c)(1),
(2), (4) Date: Apr. 28, 2005

(87) PCT Pub. No.: WO03/079497

PCT Pub. Date: Sep. 25, 2003

(65) Prior Publication Data

US 2005/0173731 A1 Aug. 11, 2005

(30) Foreign Application Priority Data

Mar. 20, 2002 (JP) ..... 2002-079749

(51) Int. Cl.
*H01R 4/58* (2006.01)

(52) U.S. Cl. ..... 439/91; 439/591

(58) Field of Classification Search ..... 439/91
See application file for complete search history.

(56) References Cited

U.S. PATENT DOCUMENTS 3,714,706 A * 2/1973 Reizman et al. ..... 29/868
3,982,320 A 9/1976 Buchoff et al.
3,998,513 A 12/1976 Kobayashi et al.
4,778,950 A * 10/1988 Lee et al. ..... 174/35 GC
4,949,455 A * 8/1990 Nakamura et al. ..... 29/843
5,262,226 A 11/1993 Yoshida
5,515,604 A * 5/1996 Horine et al. ..... 29/830
6,581,276 B2 * 6/2003 Chung ..... 29/825
2005/0233620 A1 * 10/2005 Hasegawa ..... 439/91

FOREIGN PATENT DOCUMENTS

GB 2041828 A * 9/1980
JP 60-50468 U 4/1985

(Continued)

OTHER PUBLICATIONS

European Search Report, Application No. 03744536.8—2214 PCT/JP0303463, dated Jul. 12, 2005.

*Primary Examiner*—Hae Moon Hyeon
(74) *Attorney, Agent, or Firm*—Rader, Fishman & Grauer PLLC

(57) ABSTRACT

An anisotropic conductive sheet interposed between a circuit board such as a substrate and various circuit parts to render them conductive and its manufacturing method. The anisotropic conductive sheet has a fine pitch required by the recent highly integrated circuit boards and electronic parts, and exhibits conductivity in only the direction of thickness of the sheet due to the use of conductive thin layers such as of a metal which does not slip out. The anisotropic conductive sheet (10) includes conductive thin layers (30) that are scattering in the direction of plane of the anisotropic conductive sheet (10) and are penetrating through in the direction of thickness of the anisotropic conductive sheet (10).

14 Claims, 4 Drawing Sheets

FOREIGN PATENT DOCUMENTS

| | | | |
|---|---|---|---|
| JP | 61-240511 | A | 10/1986 |
| JP | 61-240512 | A | 10/1986 |
| JP | 63-117066 | U | 7/1988 |
| JP | 03-289074 | A | 12/1991 |
| JP | 11-231010 | A | 8/1999 |
| JP | 11-260446 | A | 9/1999 |
| JP | 08-285917 | A | 11/1999 |
| JP | 11-345643 | A | 12/1999 |
| JP | 2000-58158 | A | 2/2000 |
| JP | 2000-113923 | A | 4/2000 |
| JP | 2000-243489 | A | 9/2000 |
| JP | 2000-340037 | A | 12/2000 |
| JP | 2001-266975 | A | 9/2001 |
| JP | 2001-332322 | A | 11/2001 |

* cited by examiner

ANISOTROPIC CONDUCTIVE SHEET AND ITS MANUFACTURING METHOD

FIELD OF THE INVENTION

The present invention relates to an anisotropic conductive sheet, which is interposed between a circuit board such as a substrate and various circuit devices (components) to render conductive path, and to its manufacturing method.

RELATED ART

As recent electronic devices become smaller and thinner, there has been more and more increased necessity of connections between circuits of fine patterns and between a minute portion and a circuit of fine patterns and there has been employed a method of interposing an anisotropic conductive elastomer sheet between the electronic parts and the circuit board to render them conductive.

The anisotropic conductive elastomer sheet refers to an elastomer sheet that is conductive only in a specific direction. Generally, there are anisotropic conductive elastomer sheets, which are conductive in only the direction of thickness or would be conductive in only the direction of thickness if pressed in the direction of thickness. Owing to their features of achieving compact electrical connection without any other means such as soldering or mechanical fitting and enabling soft connection so as to absorb mechanical shock and distortion, the anisotropic conductive elastomer sheets have been extensively used in such fields as cell phones, electronic computers, electronic digital timepieces, electronic cameras, computers and the like. They are, further, extensively used as connectors for accomplishing electrical connection between a circuit device such as a printed circuit board and a lead-less chip carrier or a liquid crystal panel.

In the electric inspection of the circuit devices such as printed circuit boards and semiconductor integrated circuits, further, an anisotropic elastomer sheet is heretofore interposed between a region of electrodes of the circuit device to be inspected and a region of inspecting electrodes of the circuit board for inspection in order to achieve electrical connection between the electrodes to be inspected, which are formed on at least one surface of the circuit device to be inspected, and the inspecting electrodes formed on the surface of the inspecting circuit board.

It is known that an example of the above anisotropic conductive elastomer sheet may be obtained by cutting an anisotropic conductive block in a thin sheet such that the block that is formed integrally with thin metal wires disposed in parallel and insulating material enclosing the metal wires is cut in a direction orthogonal to the direction of the thin metal wires (JP-A-2000-340037).

In the anisotropic conductive film with thin metal wires, however, it is difficult to shorten distance between such thin metal wires and to secure anisotropic conductivity with a fine pitch as required by recent highly integrated circuit boards and electronic components. Further, it is likely that thin metal wires are to be buckled with compressive force or the like during the use thereof and easily pulled out after repetitive use so that the anisotropic conductive film may fail to keep its function to a sufficient degree.

In view of the above problems, therefore, this invention provides an anisotropic conductive sheet having a fine pitch as required by the recent highly integrated circuit boards and electronic parts preventing conductive members such as metal wires from slipping out.

DISCLOSURE OF THE INVENTION

The present invention has a feature in that an anisotropic conductive sheet includes electrically conductive thin layers that are scattering in the anisotropic conductive sheet in the direction of plane thereof and are penetrating through the anisotropic conductive sheet in the direction of thickness thereof.

More specifically, the present invention provides the following.

(1) An anisotropic conductive sheet expanding on a first plane, wherein when a first direction contained in said first plane is denoted as X-direction, a direction orthogonal X-direction and contained in said first plane is denoted as Y-direction and a direction orthogonal to X-direction and Y-direction is denoted as Z-direction, wherein said anisotropic conductive sheet has a predetermined thickness in Z-direction and a front surface and a back surface substantially in parallel with said first plane, the anisotropic conductive sheet comprising: a nonconductive matrix expanding on said first plane; and conductive thin layers scattered in said nonconductive matrix with two surfaces spaced apart across a predetermined thickness, at least one of the two surfaces being arranged in contact with said nonconductive matrix, wherein said conductive thin layers extend in Z-direction and penetrate throughout from the front surface to the back surface.

(2) An anisotropic conductive sheet expanding on a first plane, wherein when a first direction contained in said first plane is denoted as X-direction, a direction orthogonal to X-direction and contained in said first plane is denoted as Y-direction and a direction orthogonal to X-direction and Y-direction is denoted as Z-direction, wherein the anisotropic conductive sheet has a predetermined thickness in Z-direction and a front surface and a back surface substantially in parallel with said first plane being spaced apart across said predetermined thickness, the anisotropic conductive sheet comprising: strip-like members with conductive thin layers extending in X-direction, the strip-like members with the conductive thin layers being composed of nonconductive strip-like members having thickness in Z-direction and width in Y-direction and extending in X-direction; and the conductive thin layers being adhered to side surfaces of said nonconductive strip-like members substantially along Z-direction and having narrow width in X-direction along the side surfaces of said nonconductive strip-like members and extending from the front surface to the back surface of the anisotropic conductive sheet penetrating therethrough in Z-direction, wherein said strip-like members with the conductive thin layers being positioned and coupled to each side of each strip-like member so as to line up in Y-direction.

(3) The anisotropic conductive sheet according to (1) or (2), wherein said conductive thin layers are adhered to said nonconductive matrix or to said nonconductive strip-like members via an adhesive layer.

(4) The anisotropic conductive sheet according to any one from (1) to (3), wherein said conductive thin layers comprise at least a set of a flexible layer and a good conductive layer.

(5) The anisotropic conductive sheet according to any one from (1) to (4), wherein said nonconductive matrix or said nonconductive strip-like members comprise nonconductive elastomer.

(6) A method of manufacturing an anisotropic conductive sheet comprising: an adhering step of adhering conductive thin layers on the surface of a nonconductive sheet (A) being composed of nonconductive material to obtain a nonconductive sheet (A) with the conductive thin layers; an AB sheet stacking step of stacking nonconductive sheets (B) with the conductive thin layers obtained in the adhering step of adhering the layer to obtain an AB sheet laminate; and a cutting step of cutting the AB sheet laminate obtained in the AB sheet stacking step of obtaining the AB sheet laminate in a predetermined thickness.

In this invention, it is characterized in that an anisotropic conductive sheet which is conductive in the direction of thickness of the sheet, but is nonconductive in the direction contained in the plane thereof, comprises conductive thin layers penetrating the sheet in the direction of thickness, wherein the conductive thin layers are scattered as being insulated from each other. Penetrating throughout from the front surface to the back surface of the sheet stands for the penetration in the direction of thickness of the sheet, and may mean that the conductive thin layer (which may include a metal layer when metal is used) appears on both front and the back surfaces of the anisotropic conductive sheet. In the case of a metal layer, the metal layer as a whole may be made of a single kind of metal. Further, the front surface side may be electrically connected to the back surface side. Here, being insulated from each other may mean that the individual thin conductive layers are not electrically connected to each other. It can be so comprehended that the individual conductive thin layers are electrically independent (or insulated). Being scattered means that a plurality of electrically conductive thin layers are scattered separately from each other on X-Y plane which is a first plane of the anisotropic conductive sheet and are penetrating throughout the sheet in Z-direction. Further, it may be so considered that the conductive thin layers are arranged being separated away from each other in the matrix made of nonconductive members. Further, the individual conductive thin layers may exist in a state of being separated away from each other. Here, when the conductive thin layers are made of a metal, they may be called metal layers. In the case of the metal layers, the metal layers as a whole may include the case of being made of a single kind of metal.

In this invention, it is characterized in that an anisotropic conductive sheet which is conductive in the direction of thickness of the sheet, but is nonconductive in the direction contained in the plane thereof, comprises a plurality of strip-like nonconductive members with conductive thin layers disposed onto the members in a separate manner, wherein the plurality of strip-like nonconductive members are aligned to constitute the anisotropic conductive sheet and wherein the conductive thin layers penetrate the sheet in the direction of thickness. Being disposed in a separate manner may mean that the layers are not electrically connected in a continuous manner, or may mean that the layers are not physically connected in a continuous manner. The strip-like nonconductive member may stand for a nonconductive member of a slender shape. Being slender means that the ratio of the longitudinal length to the transverse length exceeds 1 and, more preferably, exceeds 10. That the plural members are aligned may mean a state or a structure in which the same or different kinds of strip-like nonconductive members with the conductive thin layer are consecutively arranged in Y-direction (transverse direction) of the nonconductive strip-like members. It may include a constitution in which these strip-like members are coupled together with a coupling agent to integrally form the sheet.

In the present invention, it may be further characterized in that the conductive thin layers are adhered to the strip-like nonconductive members via adhesive layers. Here, the adhesive layer is to adjust (which may include "absorb" and "relax") differences in physical and/or chemical properties (e.g., elastic modulus, plastic deformation rate, thermal expansion rate, thermal conductivity, electronegativity, etc.) of the conductive thin layer (which may include a metal layer when metal is used) and of the nonconductive member (e.g., nonconductive strip-like member) such that the adhesive layer may improve the adhesion between the conductive thin layer and the nonconductive member. The adhesive layer may, for example, be a layer made of material having intermediate properties between the physical and/or chemical properties of the two, or may be a layer (including a layer of material having such physical and/or chemical properties as cause strong coupling) for strongly coupling the two. It also may be characterized in that the adhesive layer is made of metal oxide or metal. Examples of the metal oxide include indium oxide, tin oxide, titanium oxide or mixture thereof or compound thereof, and examples of the metal include chromium, etc. For example, it may be characterized in that the adhesive layer comprises indium tin oxide (or indium oxide/tin oxide). The "indium tin oxide (or indium oxide/tin oxide)" is abbreviated as ITO and is ceramic material having a high degree of electric conductivity.

The conductive thin layer (which may include a metal layer when metal is used) may include at least a set of a layer (flexible layer) made of flexible metal and a layer (good conductive layer) made of metal having good electric conductivity. The flexible layer may have a function to modify the shape flexibly without being broken down by the distortion of the member to which the conductive thin layer (which may include a metal layer when metal is used) is adhered. In particular, it is considered that the flexible layer plays an important role during the handling when it is adhered to the substrate made of flexible material that can be bent, twisted, drawn or contracted. For example, the substrate made of material such as macromolecule material or elastomer is likely to undergo such deformation. Further, even the substrate made of rigid material tends to be deformed in a similar manner when its thickness is small. A good conductive layer is constituted of metal having high electric conductivity and may have a function to lower the resistance in the direction of thickness of the anisotropic conductive sheet. Further, since at least one set of layers are used, two or more sets of soft layers and good conductive layers may be included so as to be more capable of absorbing the distortion. However, an increase in the number of the layers makes the steps more complex. The good conductive layer may be sandwiched by the flexible layers at all times.

The layer made of flexible material may be a layer of metal which flexibly deforms itself to meet the external deformation, for example, the substrate deformation. The layer may not be cracked or broken so as not to develop electric breakdown. Further, the layer made of metal having good electric conductivity is the one made of metal having higher electric conductivity than the above flexible metal in an environment in which it is used. More preferably, the electric conductivity of metal having good conductivity is higher than that of the above flexible metal and is, more preferably, at least two times as high, and, yet more preferably, at least five times as high as that of the flexible metal. The above metal layers are combined together since it was found that the flexibility and good conductivity are not necessarily satisfied by a single kind of metal.

As flexible metal, there can be exemplified pure metal such as indium, tin or lead, or alloys such as indium and tin. According to "Rikagaku Jiten" (Iwanami Shoten Co.), indium is flexible yet having resistivity of $8.4\times10^{-6}$ Ωcm, tin has resistivity of $11.4\times10^{-6}$ Ωcm, and lead has resistivity of $20.8\times10^{-6}$ Ωcm. On the other hand, as the metal having good electric conductivity, there can be exemplified pure metal such as copper, silver, gold and alloys thereof. Similarly, according to "Rikagaku Jiten" (Iwanami Shoten Co.), copper has resistivity of $1.72\times10^{-6}$ Ωcm, silver has resistivity of $1.62\times10^{-6}$ Ωcm, and gold has resistivity of $2.2\times10^{-6}$ Ωcm. It will therefore be learned that flexible metal has resistivity at least twice as great as metal having good conductivity.

In the multiplicity of conductive thin layers (which may include a metal layer when metal is used), it is important that the layer of flexible metal and the layer of metal having good conductivity are electrically contacted to each other. Even when the layer made of good conductive metal is broken due to handling or the like so that the electricity is interrupted from flowing through the broken portion, it is expected that electricity flows into the layer of flexible metal being contacted so as to bypass the broken portion. As described above, the flexible metal has low electric conductivity. Once the broken portion is bypassed, therefore, electricity can be conducted to the other side of the layer made of good conductive metal across the bypassed broken portion. Owing to this structure, the layer made of flexible metal works as a redundant system for the passage of electricity. When there is a diffusion to some extent between the layers, adhesion is improved between the layers and, as a result, it is expected that the multi-layer function is improved. However, if the diffusion takes place too much to establish a completely mixed state, the multi-layer function decreases.

The anisotropic conductive sheet of the present invention is characterized in that it has conductivity in the direction of thickness of the sheet but has no conductivity in the direction of plane.

Here, being conductive may mean that the anisotropic conductive sheet having the above constitution has sufficiently high conductivity in the direction of thickness of the sheet. Usually, it is desired that the resistance among the terminals to which the connection is made by the anisotropic conductive sheet is, usually, not larger than 100 Ω (preferably, not larger than 10 Ω and, more preferably, not larger than 1 Ω). Being nonconductive may mean that the anisotropic conductive sheet exhibits no conductivity or exhibits insulating property, or exhibits a very low conductivity, or exhibits a very high electric resistance. At ordinary voltage (in a range of from several volts to several hundreds of volts), the anisotropic conductive sheet may exhibit a resistance of not smaller than 1 kΩ, and more preferably, not smaller than 1 MΩ.

In the anisotropic conductive sheet of the present invention, it may be also characterized in that the nonconductive matrix comprises a nonconductive elastomer, and the conductive members comprise a conductive elastomer.

The nonconductive elastomer is referred to elastomer without conductivity or having a very low conductivity and ordinary elastomer belongs to such elastomer. For example, as the nonconductive elastomer, butadiene copolymers such as natural rubber, polyisoprene rubber, butadiene/styrene, butadiene/acrylonitrile, butadiene/isobutylene, conjugated diene rubber and hydrogenated compounds thereof; block copolymer rubbers such as styrene/butadiene/diene block copolymer rubber, styrene/isoprene block copolymer, and hydrogenated compounds thereof; and chloroprene copolymer, vinyl chloride/vinyl acetate copolymer, urethane rubber, polyester rubber, epichlorohydrin rubber, ethylene/propylene copolymer rubber, ethylene/propylene/diene copolymer rubber, soft liquid epoxy rubber, silicone rubber and fluorine-contained rubber may be used. Among them, the silicone rubber is preferably used owing to its excellent heat resistance, cold resistance, chemical resistance, aging resistance, electric insulation and safety. The nonconductive elastomer usually has a high volume resistivity (e.g., not smaller than 1 MΩ-cm at 100 V) and is nonconductive.

In producing an anisotropic conductive sheet by arranging the strip-like members of the nonconductive elastomer, they may be chemically coupled together. In order to chemically bond them, a coupling agent may be applied among them. The coupling agent is the one for coupling these members, and may include an adhesive usually available in the market. For example, coupling a gents of the types of silane, aluminum and titanate may be used. Among them, a silane coupling agent is favorably used.

A method of manufacturing an anisotropic conductive sheet according to the present invention comprises the steps of: adhering conductive thin layers (which may include a metal layer when metal is used) on the surface of a nonconductive sheet made of nonconductive members to obtain a nonconductive sheet with the conductive thin layers (which may include a metal layer when metal is used); laminating a sheet member made of the nonconductive members with the conductive thin layers (which may include a metal layer when metal is used) to obtain a laminate; and cutting the laminate in a predetermined thickness.

Here, the nonconductive sheet may be a sheet member of a single kind or a collection of sheet members of different kinds. For example, the nonconductive sheet may be a collection of sheet members of the same material but having different thicknesses. In the step of adhering the conductive thin layers (which may include a metal layer when metal is used) onto the surface of the nonconductive sheet made of the nonconductive members, the conductive thin layers (which may include a metal layer when metal is used) may be adhered onto one surface or onto both surfaces of the sheet members. The conductive thin layers (which may include a metal layer when metal is used) can be adhered by any one of the vapor phase method, liquid phase method or solid phase method or by a combination thereof. Among them, the vapor phase method is particularly preferred. As the vapor phase method, it can be exemplified that PVD such as a sputtering method, a vacuum deposition method, and CVD. The conductive thin layers (which may include a metal layer when metal is used) may be adhered onto the nonconductive sheet via an adhesive layer. Further, the conductive thin layers (which may include a metal layer when metal is used) may be so constituted as to include at least a set of a flexible layer and a good conductive layer. In this case, the individual layers may be adhered by the same method or by different methods. The conductive thin layer with a narrow width is necessary to be adhered. Usually, the conductive thin layers are adhered by sputtering while applying a mask to the portions where the conductive thin layers are not to be adhered.

The nonconductive sheets with the conductive thin layers (which may include a metal layer when metal is used) are stacked. Stacking may mean that the nonconductive sheets with the conductive thin layers (which may include a metal layer when metal is used) are stacked in the direction of thickness of the sheet, which, however, does not exclude interposing a third sheet, a film or any other members among the nonconductive sheets with the conductive thin layers (which may include a metal layer when metal is used). In the step of stacking the sheet members, further, a coupling agent may be applied among the sheets so that the sheets are coupled together. The laminate prepared by stacking may be heated from the standpoint of increasing the coupling among the sheets, promoting the curing of the sheet members themselves or for any other purpose.

The laminate can be cut by using a blade such as a cemented carbide cutter or a ceramic cutter, by using a grindstone such as a fine cutter, by using a saw, or by using any other cutting device or cutting instrument (which may include a cutting device of the non-contact type, such as laser cutter). In the step of cutting, further, there may be used a cutting fluid such as a cutting oil to prevent overheating, to obtain finely cut surfaces or for any other purpose, or a dry cutting may be employed. Further, the object to be cut may be cut alone or by being rotated together with the cutting machine or instrument. It needs not be pointed out that a variety of conditions for cutting are suitably selected to meet the laminate. To cut in a predetermined thickness means to cut to obtain a sheet member having a predetermined thickness. The predetermined thickness needs not be uniform but may vary depending upon the places of the sheet member.

DESCRIPTION OF THE PREFERRED EMBODIMENT

The present invention will now be described in further detail by way of embodiments with reference to the drawings. However, the embodiments are simply to illustrate concrete materials and numerical values as preferred examples of the present invention, but are not to limit the present invention.

Figure 1:
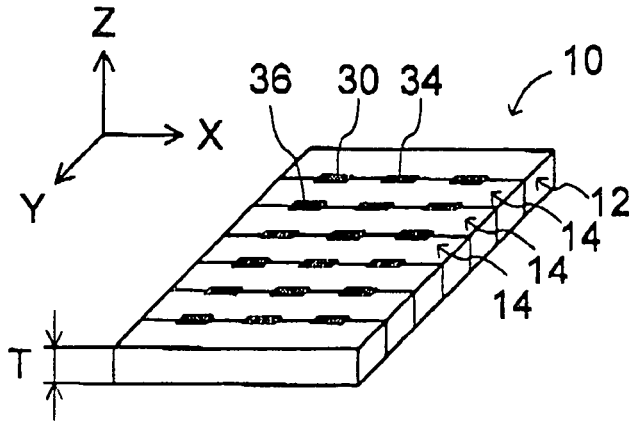
FIG. 1 is a perspective view illustrating an anisotropic conductive sheet using conductive thin layers (which may include a metal layer when metal is used) according to an embodiment of the present invention.

FIG. 1 illustrates an anisotropic conductive sheet 10 according to an embodiment of the present invention using conductive thin layers (which may include a metal layer when a metal is used) as the conductive thin layers of the present invention. A Cartesian coordinate system XYZ of the anisotropic conductive sheet 10 is illustrated at a left upper part. The anisotropic conductive sheet 10 of this embodiment is a rectangular sheet member but may be a sheet member of a shape other than the rectangular shape. The anisotropic conductive sheet 10 is constituted by arranging a strip-like member 12 which is nonconductive member at an upper end followed by strip-like members 14 which are nonconductive members with the conductive thin layers (which may include a metal layer when a metal is used) which are arranged in the lateral direction (direction of width). The strip-like member 12 made of the nonconductive member and the strip-like member 14 made of the nonconductive member with the conductive thin layers (which may include a metal layer when a metal is used), and the neighboring strip-like members 14 made of the nonconductive members with the conductive thin layers (which may include a metal layer when a metal is used), are coupled together by using a coupling agent. These members made of the nonconductive material may form a nonconductive matrix, and the conductive thin layers made of the conductive material may be regarded as scattering conductive thin layers. In the anisotropic conductive sheet 10 of this embodiment, the nonconductive elastomer is a silicone rubber manufactured by Mitsubishi Jushi Co. or a silicone rubber manufactured by Shin-etsu Polymer Co., and the coupling agent is a silane coupling agent manufactured by Shin-etsu Polymer Co. Further, a multiplicity of conductive thin layers (which may include a metal layer when a metal is used) that will be described later are used as the conductive thin layers (which may include a metal layer when a metal is used).

Figure 2:
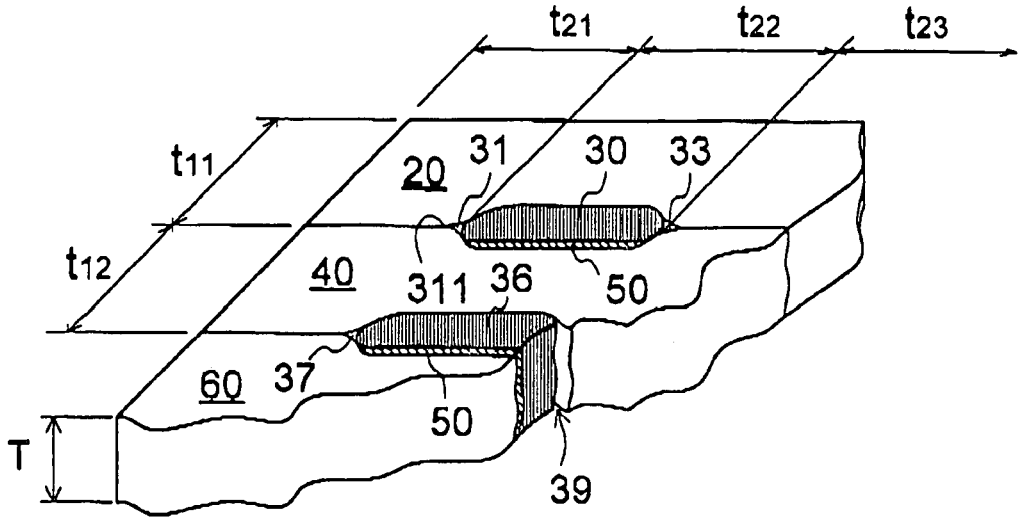
FIG. 2 is a view illustrating the enlarged upper left portion of the anisotropic conductive sheet in FIG. 1 according to the embodiment of the present invention.

FIG. 2 is a view illustrating on an enlarged scale the left upper corner portion of FIG. 1, i.e., illustrates the two kinds of strip-like members 12 and 14 in further detail. The strip-like member 20 corresponds to the strip-like member 12 made of the nonconductive member of FIG. 1, and the strip-like member 40 corresponds to the strip-like member 14 made of the nonconductive member with the conductive thin layers (which may include a metal layer when a metal is used) 30 of FIG. 1. In FIG. 1, the extreme left upper conductive thin layer (which may include a metal layer when a metal is used) 30 is adhered, as shown in FIG. 2, to the strip-like member 40 made of the nonconductive member via an adhesive layer 50. The strip-like members 20 and 40 are coupled together with a coupling agent. Here, the strip-like members are protruded by the amount of the conductive thin layer (which may include a metal layer when a metal is used). Therefore, gaps 31 and 33 which occur due to no-matching develop on both sides of the conductive thin layer (which may include a metal layer when a metal is used). Here, however, no gaps develop if the conductive thin layer (which may include a metal layer when a metal is used) is very thin. These gaps may simply remain as the gaps or may be filled with a coupling agent or with any other filler. Usually, if the gaps remain empty, acute crack ends 311 develop into cracks. As a result, the strip-like members 20 and 40 that are coupled together may often be separated. From this point of view, therefore, it is desired to fill the gaps. A coupling agent, an adhesive agent or any other coupling material may be applied on the upper surface of the conductive thin layer (which may include a metal layer when a metal is used)(on the side that comes in contact with the nonconductive strip-like member) so as to be joined to the strip-like member 20 made of the nonconductive member, or may not be joined thereto. What is concerned to the above conductive thin layer (which may include a metal layer when a metal is used) also applies to other conductive thin layers (which may include a metal layer when a metal is used) (e.g., metal layer 36 may be included). In this case, the strip-like member 40 corresponds to the strip-like member 20 made of the nonconductive member. This also holds for the gaps 37 and 39.

The thickness of these strip-like members remains substantially the same (T) in this embodiment and, hence, the sheet has the thickness T. As described above, the neighboring strip-like members 12 and 14 are coupled together with the coupling agent and constitute a piece of sheet as shown in FIG. 1. Here, the coupling agent is nonconductive, and the sheet is nonconductive in the direction of the plane thereof. In this embodiment, the conductive thin layers (which may include a metal layer when a metal is used) are arranged on one side. In other embodiments, however, the conductive thin layers (which may include a metal layer when a metal is used) may be arranged on both sides.

The strip-like members 20, 40, 60, - - - have widths $t_{11}$, $t_{12}$, - - -. In this embodiment, these widths are all the same. In other embodiments, however, these widths may all be the same or different. The width can be easily adjusted in producing the anisotropic conductive sheet of the embodiment that will be described later. The conductive thin layer (which may include a metal layer when a metal is used) 30 is formed starting from a distance $t_{21}$ from the left of the strip-like member 40 and has a length $t_{22}$. A gap is $t_{23}$ up to the right neighboring conductive thin layer (which may include a metal layer when a metal is used) 34. The lengths and gaps of these conductive thin layers (which may include a metal layer when a metal is used) remain constant, respectively, in this embodiment, but, in other embodiments, may all be the same or different. The lengths and gaps can be easily adjusted in producing the anisotropic conductive sheet 10 of the embodiment that will be described later.

In this embodiment, the conductive thin layer (which may include a metal layer when a metal is used) 30 has a length of approximately 50 μm, a gap to the right neighboring conductive thin layer (which may include a metal layer when a metal is used) 34 is approximately 30 μm, and the nonconductive strip-like members 40, 60, - - - to which the conductive thin layers (which may include a metal layer when a metal is used) 30, 36 are adhered have a width of approximately 50 μm. In other embodiments, however, the gaps and widths may be longer (or larger) or shorter (or smaller) than those mentioned above.

In general, it is desired that the conductive thin layers (which may include a metal layer when a metal is used) are thinner than the width (e.g., $t_{12}$) of the strip-like members 40, 60, - - -, and, more preferably, smaller than 1/10 thereof and, particularly preferably, smaller than 1/50 thereof. When the strip-like members 40, 60, - - - have a width of as long as 0.1 mm or more, it is desired that the thickness of the conductive thin layers (which may include a metal layer when a metal is used) has a thickness of not larger than 10 μm.

Though there is no particular limitation on the thickness, width or length, when used for connecting the circuit board and the terminals of electronic parts, it is desired that the anisotropic conductive sheet of this embodiment has a size that matches with these sizes. In this case, the sizes are, usually, 0.5 to 3.0 cm×0.5 to 3.0 cm and 0.5 to 2.0 mm in thickness.

Figure 3:
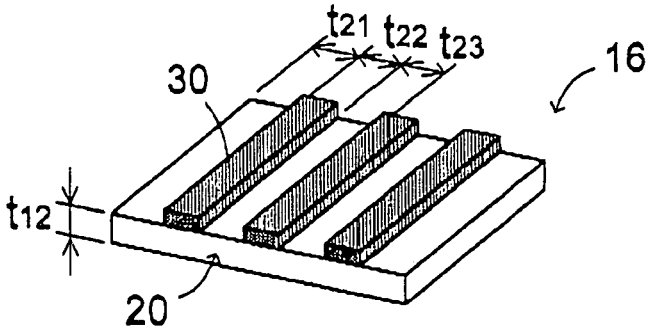
FIG. 3 is a perspective view illustrating a nonconductive sheet with the conductive thin layer (a metal layer may be included when metal is used) used in the embodiment of the present invention.
Figure 4:
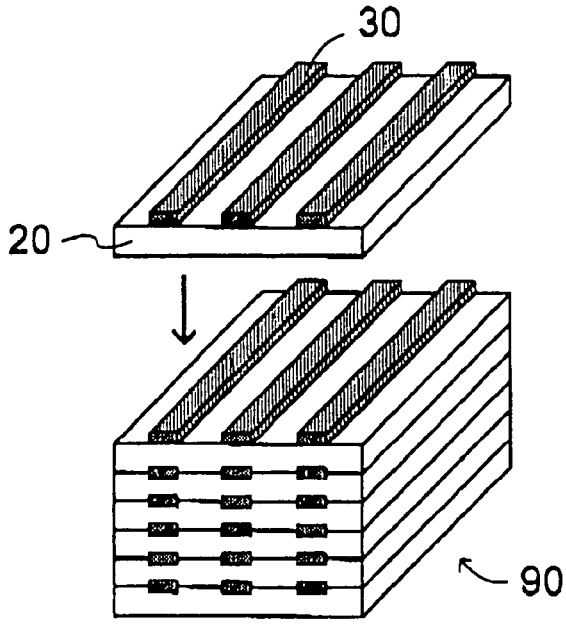
FIG. 4 is a view illustrating a step of laminating nonconductive sheets with the conductive thin layers (which may include a metal layer when metal is used as related to a method of manufacturing the anisotropic conductive sheet using the conductive thin layers (which may include a metal layer when metal is used) according to the embodiment of the present invention.

A method of manufacturing the anisotropic conductive sheet of the above embodiment will now be described with reference to FIGS. 3 to 5. FIG. 3 illustrates a sheet 16 made of nonconductive members with conductive thin layers. The thickness $t_{12}$ corresponds to the width $t_{12}$ of the strip-like member 40 of FIG. 1. FIG. 4 illustrates stacking the nonconductive strip-like members 20 having conductive thin layers (which may include a metal layer when a metal is used) 30 adhered thereon. The conductive thin layers (which may include a metal layer when a metal is used) 30 can be adhered by various methods. In this embodiment, however, they are adhered by sputtering. That is, by using the nonconductive sheet 20 as a substrate, a target is so adjusted as to meet the component of the thin conductive layers (which may include a metal layer when a metal is used) 30, and the conductive thin layers (which may include a metal layer when a metal is used) 30 are adhered by using a sputtering apparatus. The width of the conductive thin layer (which may include a metal layer when a metal is used) and the gap can be adjusted by the masking that meets therewith. The nonconductive sheet of this embodiment is a nonconductive elastomer, and a contrivance should be so made that the temperature of the substrate is not elevated too much. It is recommended to use, for example, a magnetron sputtering or an ion beam sputtering.

FIG. 4 illustrates a state of forming a laminate by stacking the nonconductive sheets 20 to which the conductive thin layers (which may include a metal layer when a metal is used) 30 are adhered. The nonconductive sheets 20 to which the conductive thin layers (which may include a metal layer when a metal is used) 30 are adhered are so stacked that the directions of the conductive thin layers (which may include a metal layer when a metal is used) are all in alignment (in parallel). On the laminate 90 being stacked, there are further stacked the nonconductive sheets 20. A coupling agent is applied among these sheets so that the sheets are coupled together. It may be so taken that the thickness of these sheets corresponds to $t_{11}$ or $t_{12}$ in FIGS. 1 and 2. That is, the widths of the strip-like members of FIGS. 1 and 2 can be freely varied by varying the thickness of these sheets. Usually, as fine pitches, these widths are not larger than approximately 80 μm and are, more, preferably, not larger than approximately 50 μm. In this embodiment, the thickness is so adjusted that the strip-like members possess a width of approximately 50 μm. Stacking the strip-like members with the conductive thin layers (which may include a metal layer when a metal is used) may include stacking one or more pieces of nonconductive sheets between the strip-like members with the conductive thin layers (which may include a metal layer when a metal is used).

Figure 5:
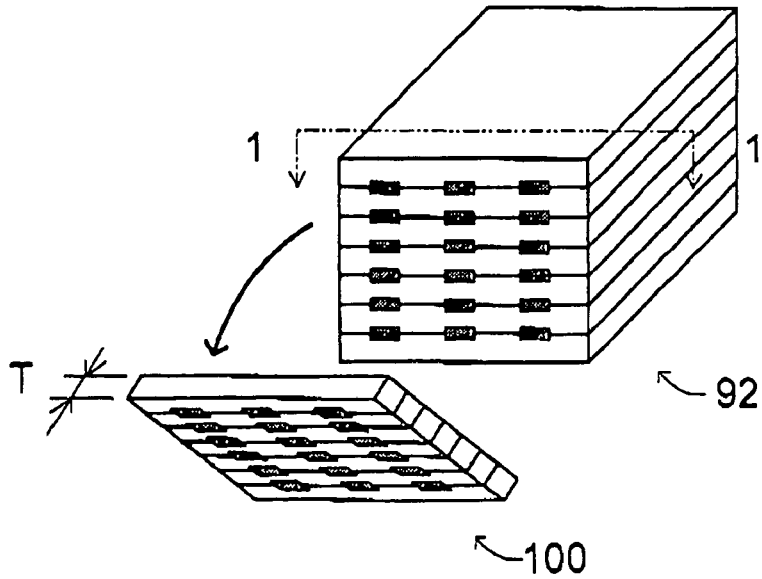
FIG. 5 is a view illustrating a step of cutting the laminate obtained in FIG. 4 as related to a method of manufacturing the anisotropic conductive sheet with the multiplicity conductive thin layers (which may include a metal layer when metal is used) according to the embodiment of the present invention.

FIG. 5 illustrates a step of cutting the laminate 92 obtained through the above step. The laminate 92 is so cut that the thickness of the obtained anisotropic conductive sheet 100 has a desired thickness T. This thickness T corresponds to T in FIGS. 1 and 2. Thus, it is allowed to easily form a thin anisotropic conductive sheet or a thick anisotropic conductive sheet which are usually difficult to produce. Usually, the thickness is approximately 1 mm. The thickness, however, can be decreased down to be smaller than approximately 100 μm (or smaller than approximately 50 μm when particularly desired) or can be selected to be about several millimeters. In this embodiment, the thickness is approximately 1 mm.

Figure 6:
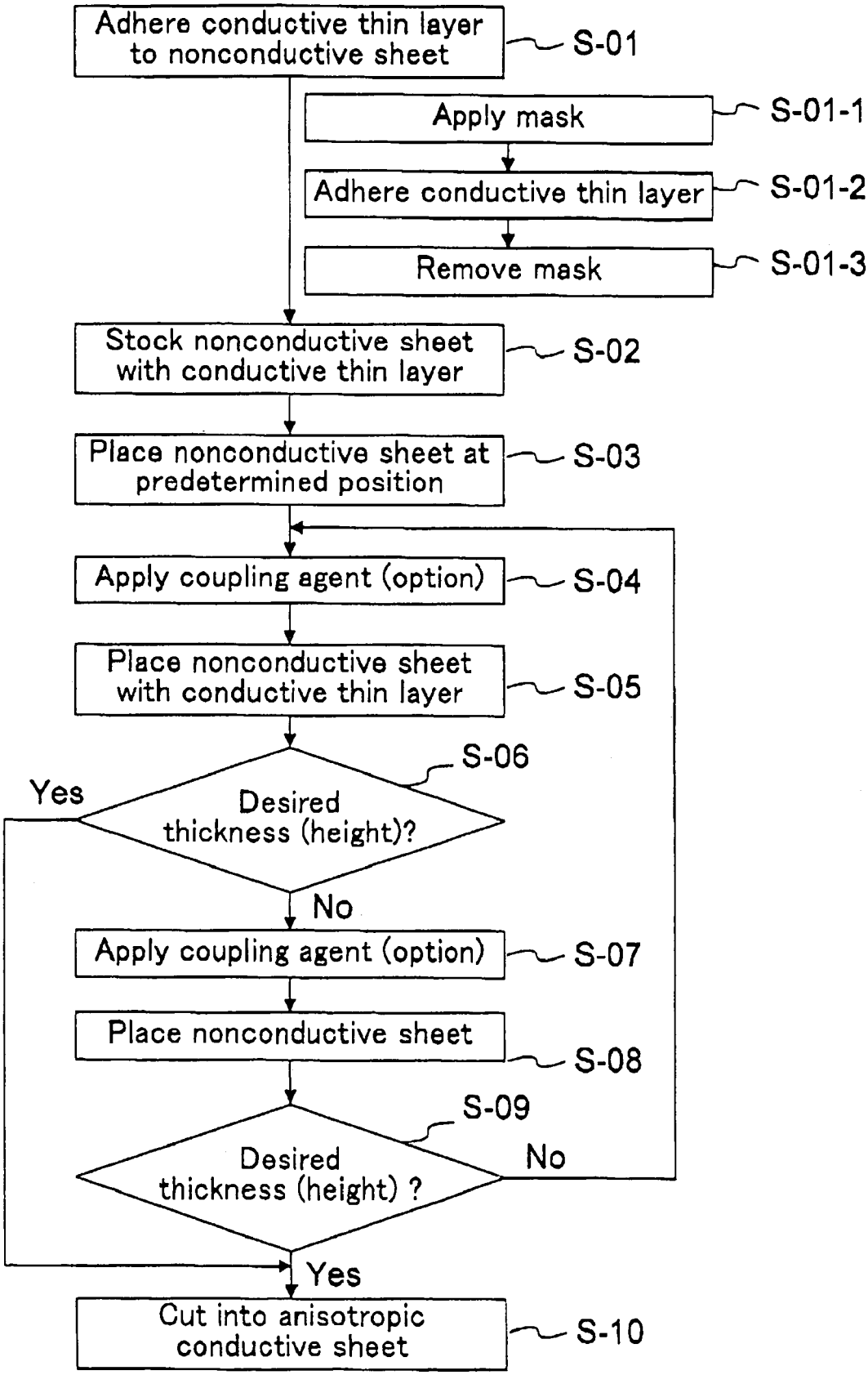
FIG. 6 is a flowchart illustrating a method of preparing the anisotropic conductive sheet using the conductive thin layers (which may include a metal layer when metal is used) according to the embodiment of the present invention.

FIG. 6 is a flowchart illustrating a method of manufacturing the above anisotropic conductive sheet. First, the conductive thin layers (which may include a metal layer when a metal is used) 30 are adhered on the nonconductive sheet 20 (S-01). In this embodiment, the conductive thin layers (which may include a metal layer when a metal is used) are formed by sputtering on one surface only of the conductive sheet. At this moment, gaps among the conductive thin layers (which may include a metal layer when a metal is used) are masked by using a tape or the like (S-01-1) so that the conductive thin layer (which may include a metal layer when a metal is used) does not adhere thereon. After the conductive thin layers (which may include a metal layer when a metal is used) are adhered (S-01-2), the masking is removed by such a method as removing the masking tape (S-01-3). The nonconductive sheet 20 with the conductive thin layers (which may include a metal layer when a metal is used) 30 is stocked for use in the next step (S-02). Next, the nonconductive sheet with the conductive thin layers (which may include a metal layer when a metal is used) is placed at a predetermined position for stacking (S-03). Optionally, the coupling agent is applied onto the nonconductive sheet (S-04). This step may be omitted, as a matter of course, since it is optional (the same holds hereinafter). The nonconductive sheet 20 with the conductive thin layers (which may include metal layers when a metal is used) 30 is placed thereon (S-05). Check if the thickness (or height) of the stacked laminate is reaching a desired thickness (or height)(S-06). If the desired (predetermined) thickness has been reached, the routine proceeds to the step of cutting (S-10). If t he desired (predetermined) thickness has not been reached, the coupling agent is optionally applied onto the conductive sheet (S-07). The nonconductive sheet with the conductive thin layers (which may include metal layers when a metal is used) is placed thereon (S-08). Check if the thickness (or height) of the stacked laminate is reaching a desired thickness (or height)(S-09). If the desired (predetermined) thickness has been reached, the routine proceeds to the step of cutting (S-10). If the desired (predetermined) thickness has not been reached, the routine returns back to step S-04 where the coupling agent is optionally applied onto the conductive sheet. At the step of cutting, the anisotropic sheet is cut out piece by piece or in a plurality of number of pieces at one time (S-10).

Figure 7:
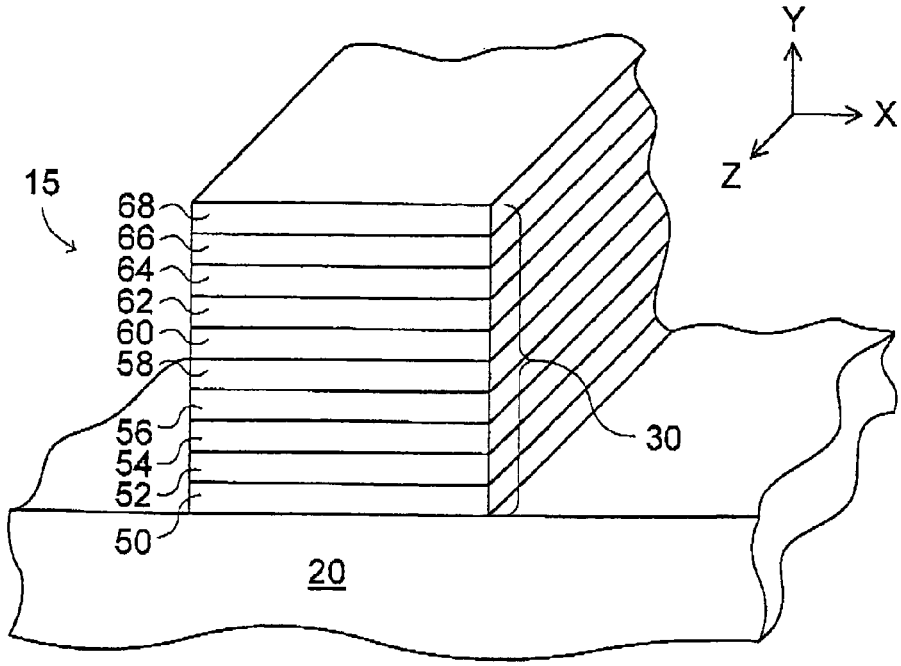
FIG. 7 is a view illustrating a portion of the nonconductive sheet with the multiplicity of conductive thin layers (which may include a metal layer when metal is used) used for the anisotropic conductive sheet that uses the multiplicity of conductive thin layers (which may include a metal layer when metal is used) according to another embodiment of the present invention.

FIG. 7 illustrates an isotropic conductive sheet according to another embodiment of the present invention, i.e., schematically illustrates a nonconductive sheet member with conductive thin layers (multiplicity of metal layers when a metal is used) obtained by adhering a multiplicity of conductive thin layers (multiplicity of metal layers when a metal is used) 30 to the nonconductive sheet member 20, which is used as a nonconductive sheet with conductive thin layers (which may include metal layers when a metal is used). Since the multiplicity of conductive thin layers (multiplicity of metal layers when a metal is used) are adhered while masking both sides of the multiplicity of conductive thin layers (multiplicity of metal layers when a metal is used) 30, the side surfaces 15 are rising like walls. The multiplicity of layers include, successively from the lower side, an adhesive layer 50 of an indium tin oxide, a flexible layer 52 of indium, a good conductive layer 54 of copper, a flexible layer 56 of indium, a good conductive layer 58 of copper, a flexible layer 60 of indium, a good conductive layer 62 of copper, a flexible layer 64 of indium, a good conductive layer 66 of copper and a flexible layer 68 of indium. The multiplicity of layers are considered to exhibit an increased resistance against the distortion from the external side. In this embodiment, the layers have such thicknesses that the adhesive layers are each approximately 500 angstroms thick, the flexible layers are each approximately 5000 angstroms thick and the good conductive layers are each approximately 5000 angstroms thick. Namely, the conductive thin layers (which may include metal layers when a metal is used) without the adhesive layer have a thickness of approximately 45000 angstroms (approximately 4.5 μm). In this embodiment, nothing has been placed on the flexible layer 68. To increase the adhesion, however, it is desired to adhere an adhesive layer. The base member 20 is made of a nonconductive elastomer having a thickness of approximately 50 to 70 μm. Such an elastomer has been manufactured by, for example, Shin-etsu Polymer Co. In this embodiment, the nonconductive elastomer is a silicone rubber manufactured by Mitsubishi Jushi Co. or a silicone rubber manufactured by Shin-etsu Polymer Co.

These thicknesses are suitably selected depending upon the conditions of use. Preferably, the adhesive layer has a thickness of approximately 50 angstroms to approximately 2000 angstroms and, more preferably, approximately 100 angstroms to approximately 1000 angstroms. The flexible layer has a thickness of approximately 500 angstroms to approximately 20000 angstroms and, more preferably, approximately 1000 angstroms to approximately 10000 angstroms. The good conductive layer has a thickness of approximately 500 angstroms to approximately 20000 angstroms and, more preferably, approximately 1000 angstroms to approximately 10000 angstroms.

The conductive thin layer (which may include a metal layer when a metal is used) 30 of this embodiment has the adhesive layer provided on the surface only of the base member 24. It is, however, also allowable to provide an adhesive layer (of the same material or different material) on the uppermost flexible layer 68. The adhesive layer may harmonize the physical and/or chemical properties of another layer contacting to the conductive thin layer (which may include a metal layer when a metal is used) or may improve the adhesion.

The flexible layers 52, 56, 60, 64 and 68 of this embodiment are all made of the same material. In other embodiments, however, they may be all made of different materials or may partly be made of the same material. The layers 52, 56, 60, 64 and 68 of flexible metals of this embodiment are made of indium.

The good conductive layers 54, 58, 62 and 66 of this embodiment are made of the same material. In other embodiments, however, they may be made of different materials or may partly be made of different materials. The layers 54, 58, 62 and 66 of good conductive metals of this embodiment are made of copper.

Figure 8:
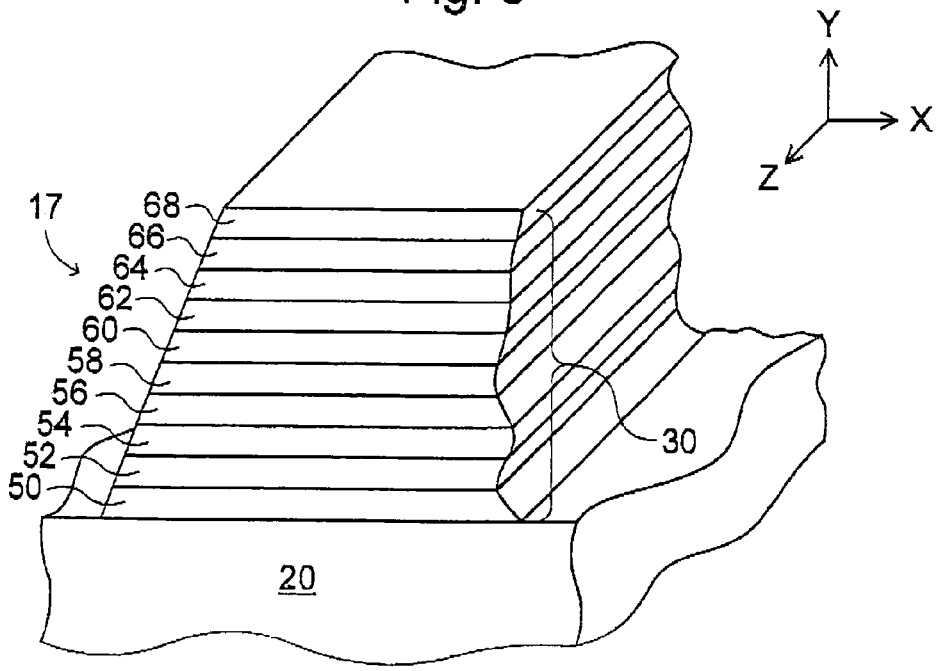
FIG. 8 is a view illustrating a portion of the nonconductive sheet with the multiplicity of conductive thin layers (which may include a metal layer when metal is used) used for the anisotropic conductive sheet that uses the multiplicity of conductive thin layers (which may include a metal layer when metal is used) according to a further embodiment of the present invention.

FIG. 8 schematically illustrates a further embodiment of the present invention. What is different from the embodiment of FIG. 7 is that in adhering a conductive thin layer (which may include a metal layer when a metal is used), the side surfaces 15 standing like walls are avoided but, instead, tilted side surfaces 17 are formed by shortening the width (or length) of the layers little by little when the layers are viewed upward from the substrate 20. In this embodiment, the mask is varied stepwise to adjust the widths of the layers. It is, however, also allowable to form the conductive thin layer (which may include a metal layer when a metal is used) and cut it aslant. In this embodiment, it is considered that gaps 31, 33, 37, 39 shown in FIG. 2 occur little, and the strip-like members are firmly bonded together.

The multiplicity of layers of this embodiment include, successively from the lower side, an adhesive layer 50 of an indium tin oxide, a flexible layer 52 of indium, a good conductive layer 54 of copper, a flexible layer 56 of indium, a good conductive layer 58 of copper, a flexible layer 60 of indium, a good conductive layer 62 of copper, a flexible layer 64 of indium, a good conductive layer 66 of copper and a flexible layer 68 of indium. The multiplicity of layers are considered to exhibit an increased resistance against the distortion from the external side. In this embodiment, the layers have such thicknesses that the adhesive layers are each approximately 500 angstroms thick, the flexible layers are each approximately 5000 angstroms thick and the good conductive layers are each approximately 5000 angstroms thick (in other embodiments, an indium-tin alloy is used in the same structure). Namely, the conductive thin layer (which may include a metal layer when a metal is used) without the adhesive layer has a thickness of approximately 45000 angstroms (approximately 4.5 μm). In this embodiment, nothing has been placed on the flexible layer 68. To increase the adhesion, however, it is desired to adhere an adhesive layer. The base member 20 is made of a nonconductive elastomer having a thickness of approximately 50 to 70 μm. Such an elastomer has been manufactured by, for example, Shin-etsu Polymer Co. In this embodiment, the nonconductive elastomer is a silicone rubber manufactured by Mitsubishi Jushi Co. or a silicone rubber manufactured by Shin-etsu Polymer Co.

As described above, the anisotropic conductive sheet of the present invention has the effect of not only maintaining insulation in the direction of the plane while exhibiting satisfactory conductivity in the direction of thickness but also enabling the sizes such a strengths of the nonconductive members and conductive thin layers to be freely set to easily accomplish fine pitches desired for achieving a high degree of integration. Further, since the conductive thin layers are directly adhered on the nonconductive members, the metal wires do not slip out which tend to occur when the linear metals are used as the conductive portions. Besides, the conductive thin layers are necessarily surrounded by the nonconductive members avoiding contact caused by the approach/contact of conductive particles in the direction of plane of the sheet, which is likely to occur in the anisotropic conductive sheet in which conductive particles such as of a metal are mixed. When the multiplicity of conductive thin layers (multiplicity of metal layers when a metal is used) a reused, it is considered that good conductivity is not lost even when the good conductive layers are cracked.

What is claimed is:

1. An anisotropic conductive sheet expanding on a first plane, wherein when a first direction contained in said first plane is denoted as X-direction, a direction orthogonal X-direction and contained in said first plane is denoted as Y-direction and a direction orthogonal to X-direction and Y-direction is denoted as Z-direction, wherein said anisotropic conductive sheet has a predetermined thickness in Z-direction and a front surface and a back surface substantially in parallel with said first plane, the anisotropic conductive sheet comprising:

a nonconductive matrix expanding on said first plane; and conductive thin layers scattered in said nonconductive matrix with two surfaces spaced apart across a predetermined thickness, at least one of the two surfaces being arranged in contact with said nonconductive matrix, wherein in said conductive thin layers each conductive thin layer comprises at least a set comprising a flexible layer and a good conductive layer, extending in the Z-direction and penetrating throughout from the front surface to the back surface.

2. The anisotropic conductive sheet according to claim 1, wherein said conductive thin layers are adhered to said nonconductive matrix or to said nonconductive strip-like members via an adhesive layer.

3. The anisotropic conductive sheet according to claim 1, wherein said nonconductive matrix or said nonconductive strip-like members comprise nonconductive elastomer.

4. The anisotropic conductive sheet according to claim 1, wherein said conductive thin layers have a tilted side surface.

5. The anisotropic conductive sheet according to claim 1, wherein the flexible layer is a layer of metal which flexibly deforms to compensate for an external deformation.

6. The anisotropic conductive sheet according to claim 5, wherein the good conductive layer is a layer of metal which has higher electric conductivity than the metal having flexibility.

7. The anisotropic conductive sheet according to claim 6, wherein the electric conductivity of a metal having good conductivity is at least two times higher than that of the metal having flexibility.

8. The anisotropic conductive sheet according to claim 7, wherein the flexible layer and good conductive layer are electrically in contact with each other.

9. The anisotropic conductive sheet according to claim 1, wherein the adhesive layer is made of material having at least one property which is intermediate between physical and chemical of the properties of the conductive layer and the nonconductive member.

10. The anisotropic conductive sheet according to claim 1, wherein the adhesive layer is made of material having at least one property selected from a physical and chemical property which strongly couples the conductive thin layer and the nonconductive member.

11. The anisotropic conductive sheet according to claim 1, wherein the conductive thin layer comprising laminated alternating flexible layers and good conductive layers in the Y-direction.

12. The anisotropic conductive sheet according to claim 11, wherein the good conductive layer is sandwiched in between the flexible layers.

13. The anisotropic conductive sheet according to claim 11, wherein the adhesive layer is also provided on the uppermost flexible layer.

14. An anisotropic conductive sheet expanding on a first plane, wherein when a first direction contained in said first plane is denoted as X-direction, a direction orthogonal to X-direction and contained in said first plane is denoted as Y-direction and a direction orthogonal to X-direction and Y-direction is denoted as Z-direction, wherein the anisotropic conductive sheet has a predetermined thickness in Z-direction and a front surface and a back surface substantially in parallel with said first plane being spaced apart across said predetermined thickness, the anisotropic conductive sheet comprising:

strip-like members with conductive thin layers extending in X-direction, the strip-like members with the conductive thin layers being composed of nonconductive strip-like members having thickness in Z-direction and width in Y-direction and extending in X-direction; and the conductive thin layers being adhered to side surfaces of said nonconductive strip-like members substantially along Z-direction and having narrow width in X-direction along the side surfaces of said nonconductive strip-like members and extending from the front surface to the back surface of the anisotropic conductive sheet penetrating therethrough in Z-direction, wherein said strip-like members with the conductive thin layers being positioned and coupled to each side of each strip-like member so as to line up in Y-direction, and wherein in said conductive thin layers, each conductive thin layer comprises at least a set comprising a flexible layer and a good conductive layer, extending in the Z-direction and penetrating throughout from the front surface to the back surface.

* * * * *